US005102147A

United States Patent [19]

Szeluga

[11] Patent Number: 5,102,147

[45] Date of Patent: Apr. 7, 1992

[54] BALLISTIC BROADHEAD ASSEMBLY

[76] Inventor: Roy R. Szeluga, 44 Silver La., East Hartford, Conn. 06118

[21] Appl. No.: 638,749

[22] Filed: Jan. 8, 1991

Related U.S. Application Data

[63] Continuation-in-part of Ser. No. 419,474, Oct. 10, 1989, abandoned.

[51] Int. Cl.[5] ..... F42B 6/08

[52] U.S. Cl. ..... 273/422

[58] Field of Search ..... 273/421, 422

[56] References Cited

U.S. PATENT DOCUMENTS

| | | | |
|---|---|---|---|
| 2,859,970 | 11/1958 | Doonan | 273/421 |
| 3,138,383 | 7/1964 | McKinzie | 273/421 |
| 4,099,720 | 7/1978 | Zeren | 273/422 |
| 4,166,619 | 9/1979 | Bergmann et al. | 273/421 |
| 4,579,348 | 4/1986 | Jones | 273/421 |
| 4,615,529 | 10/1986 | Vocal | 273/421 |
| 4,616,835 | 10/1986 | Trotter | 273/421 |
| 4,807,382 | 2/1989 | Albrecht | 43/6 |
| 4,932,671 | 6/1990 | Anderson, Jr. | 273/421 |
| 4,940,246 | 7/1990 | Stagg | 273/421 |
| 4,976,443 | 12/1990 | DeLucia | 273/421 |
| 4,998,738 | 3/1991 | Puckett | 273/421 |

*Primary Examiner*—Paul E. Shapiro

*Attorney, Agent, or Firm*—Ira S. Dorman

[57] ABSTRACT

A broadhead assembly maintains the blades, pivotably mounted on an actuating plunger, in retracted condition until impact, thereupon thrusting them outwardly and forwardly for maximum effect, and ultimately constraining them against full retraction in a partially extended, optimal position.

The blades have profile edges, including a locking section and a thrust section, which engage a positioning element to extend the blades, and to constrain them against full retraction, respectively. The assembly may additionally include an elastically deformable element for engaging the blades in their closed position, and it may also include a pair of fixed blades mounted adjacent the rearward end of the body.

15 Claims, 3 Drawing Sheets

BALLISTIC BROADHEAD ASSEMBLY

CROSS REFERENCE TO RELATED APPLICATION

This application is a continuation-in-part of copending application Ser. No. 07/419,474, filed Oct. 10, 1989.

BACKGROUND OF THE INVENTION

Movable-blade broadhead assemblies are known in the art and are commercially available. They typically include an aerodynamically configured body within which the blades are fully contained during flight, thus affording a true trajectory to the target and eliminating or minimizing the air-current deflection (i.e., wind-planing) to which fixed-blade broadheads are subject. Upon impact, the blades of such expandable broadheads are thrust outwardly, thus presenting a wide cutting surface and thereby inflicting a large, and desirably fatal, wound to hunted game.

The following U.S. Pat. Nos. are representative of the art on movable-blade broadhead assemblies: Doonan No. 2,859,970, issued Nov. 11, 1958; Bergmann et al No. 4,166,619, issued Sept. 4, 1979; Jones No. 4,579,348, issued Apr. 1, 1986; and Anderson, Jr. No. 4,932,671, issued June 12, 1990. Also of possible interest are the following U.S. Pat. Nos.: McKinzie No. 3,138,383, issued June 23, 1964; Vocal No. 4,615,529, issued Oct. 7, 1986; Trotter No. 4,616,835, issued Oct. 14, 1986; and Albrecht No. 4,807,382, issued Feb. 28, 1989.

Despite the forgoing, a need exists for a movable-blade broadhead assembly of relatively uncomplicated design, which affords accurate arrow trajectories, is highly reliable in its operation, and is highly effective for its intended purposes.

SUMMARY OF THE INVENTION

It is therefore the broad objective of the present invention to provide a movable-blade broadhead assembly that satisfies the foregoing need.

A more specific object is to provide such an assembly in which the blades, retracted during flight and released upon impact to pivot outwardly and forwardly, are thereafter disengagably locked against full retraction at a desirable degree of extension.

A subordinate object is to provide an assembly having the noted features and advantages which is, in addition, of relatively facile and inexpensive manufacture.

It has now been found that the foregoing and related objects of the invention are readily attained by the provision of a broadhead assembly comprised of an elongate body, an actuating plunger, a pair of substantially identical blades pivotably mounted on the plunger, and a positioning element. The body of the assembly has a longitudinal slot extending laterally through it; also, means is provided at the rearward end for attachment to an arrow shaft, and a passage extends longitudinally between its forward end and the slot.

The actuating plunger is comprised of a shaft, slidably mounted in the body passage, and a tip disposed on the forward end outwardly of the passage; blade-mounting means is provided on a rearward end portion of the shaft. The plunger is movable between an armed, outward position with its shaft extended, and a discharged, inward position with the shaft depressed and with the tip bearing upon the forward end of the body.

Each of the blades has a forward end portion with a pivot support element thereon, and has opposing, generally rearwardly extending lateral edges, one of the edges being sharpened and the other being formed with a positioning profile. The blades are seated in the body slot with their sharpened edges outwardly oriented and with their support elements engaging the mounting means of the plunger shaft, for free pivotable movement; they move between a closed position within the slot, in the armed position of the plunger, and open positions extended from the slot, in the discharged position thereof. The positioning element extends transaxially in the body of the assembly, traversely of the slot and at a location intermediate the ends of the body, for engagement with the profile edges of the blades.

Each profile edge is comprised of a locking section, located proximate the pivot support element of the blade for registry with the positioning element of the assembly, in the discharged position of the plunger, and a camming or thrust section extending rearwardly from the locking section. The thrust section is so disposed and configured as to cause the positioning element to effect extension of the blade toward open positions during inward movement of the plunger from its armed position. The locking section is configured to prevent full retraction of the blades, serving to constrain them to a desirably extended open position; thus, the locking section configuration is such that inward, closing force upon the blades, transmitted to the positioning element through the locking sections, produces no force vector tending to move the plunger outwardly.

DETAILED DESCRIPTION OF THE ILLUSTRATED AND PREFERRED EMBODIMENTS

Figure 1:
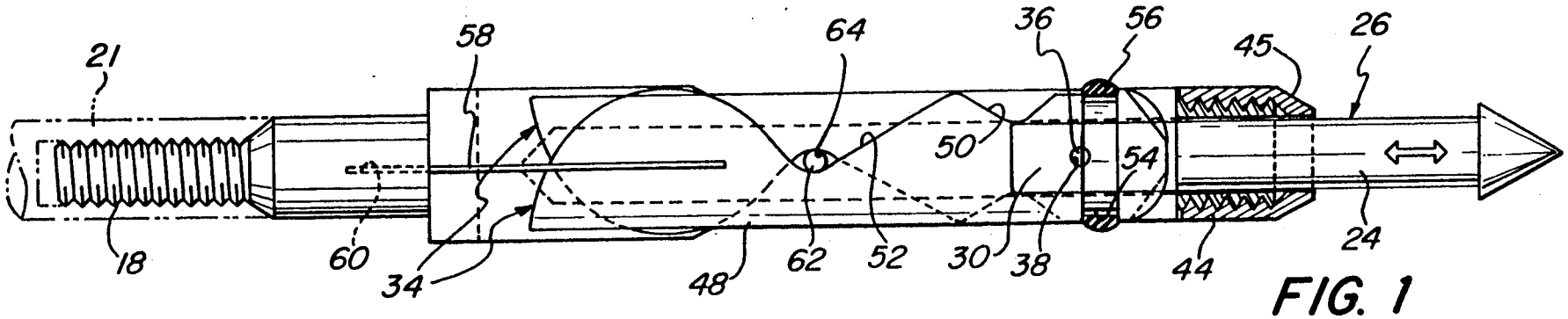
FIG. 1 is a plan view of a movable-blade broadhead assembly embodying the present invention, with portions shown in section for clarity of illustration.

Turning now in detail to the appended drawings, therein illustrated is a broadhead assembly embodying the present invention, and including a cylindrical body, generally designated by the numeral 10, having a diametrical slot 12 extending along a major portion of its length. The body 10 has a reduced-diameter threaded portion 14 at one end, adjacent to which is formed a circumferential groove 16. A threaded stub portion 18 extends from the enlarged diameter portion 20 at the opposite end of the body, and serves as the means by which the broadhead is secured to an arrow shaft 21 (fragmentarily illustrated in phantom line in FIG. 1). Bore 22 extends coaxially into the body 10 from its forward end, again occupying a major portion of its length.

The shaft 24 of an actuating piston, generally designated by the numeral 26, is slidably received within the bore 22 of the body 10. It has a pointed tip 28 on its forward end, and is bifurcated at its rearward end to define a forwardly extending slot 32.

A pair of substantially identical planar blades, each generally designated by the numeral 34, are mounted within the body 10 and are pivotably attached to the actuating piston 26. This is accomplished by inserting pin 36 through the aligned apertures 38 in the parts 30 of the bifurcated portion of the shaft 24, and through the apertures 40 formed through the forward end portions 42 of the blades 34. As will be noted, the blades are disposed within the slot 32 in an overlapping, inverted relationship to one another.

The subassembly of the piston 26 and blades 34 is held within the body 10 by the collar 44, which is threadably engaged on the end portion 14 of the body 10. The collar 44 defines a circular opening 46 at its forward end, which cooperates with the bore 22 in the body 10 t define the passage in which the piston 26 is slidably seated; the shoulder 45 on the collar is tapered to cooperate with the pointed piston tip 28 to promote penetration of the broadhead into the target.

Each blade 34 has a sharpened, rectilinear outer edge 48 and a profiled inner edge, the latter including rectilinear sections 50 and 52. Section 50 extends generally radially with respect to the center of the blade aperture 40, and diverges rearwardly with respect to the sharpened edge 48; section 52 is contiguous to section 50, and extends rearwardly therefrom in a converging relationship to the edge 48. By way of example and not limitation, edge 48 and section 50 may be oriented with respect to one another with an included angle of 35° therebetween, the included angle between edge 48 and section 52 may be 30°, and the included angle between sections 50 and 52 may be 115°. Neither the sharpened edge 48 nor the edge sections 50 and 52 need be rectilinear in order to serve their intended purposes (as are more fully described hereinbelow), and certainly other functionally equivalent configurations and relationships can be employed, as will be evident to those skilled in the art.

Small notches 54 are formed into the forward end portions 42 of the blades 34, adjacent their sharpened edges 48. They receive the rubber O-ring 56, seated in the circumferential body groove 16, to disengagably maintain the blades 34 in the closed position illustrated in FIGS. 1 and 2. A pair of auxiliary blades 58 are affixed within slots 60, to extend from the enlarged portion 20 adjacent the rear of the body 10 in mutual opposition and in a plane perpendicular to the common plane in which the blades 34 are disposed. Finally, a positioning pin 62 is fixed within the body 10 by engaging its opposite ends in aligned apertures 64; the pin 62 extends transaxially of the centerline of the body and traversely of the slot 12 (and bore 22) therein.

Figure 2:
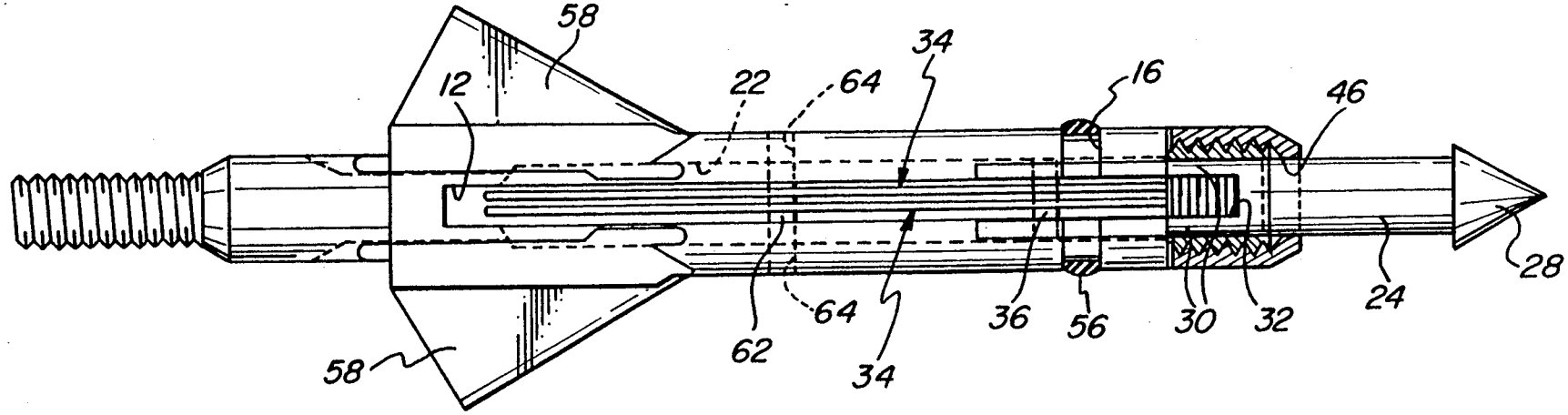
FIG. 2 is a similar, elevational view of the assembly.
Figure 3:
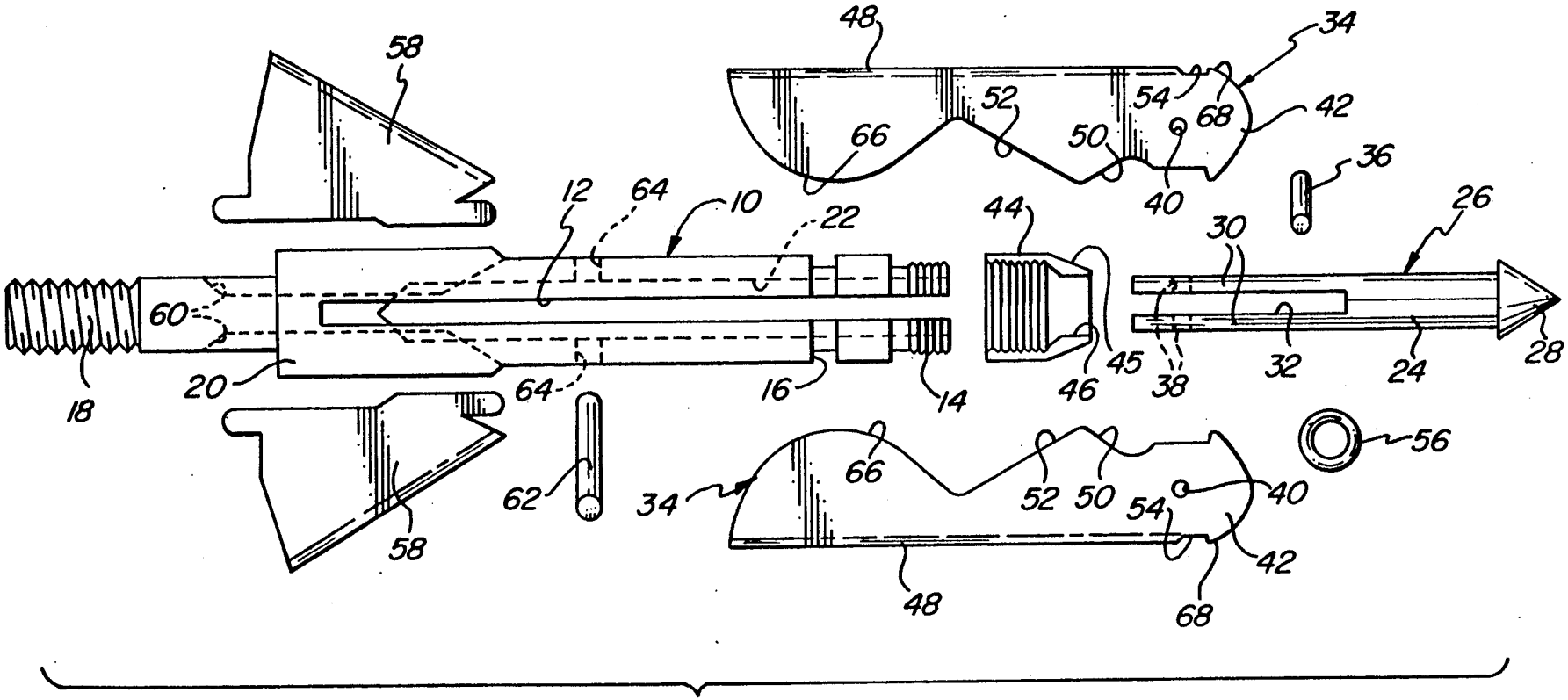
FIG. 3 is an exploded view showing the components of which the assembly is comprised.
Figure 5:
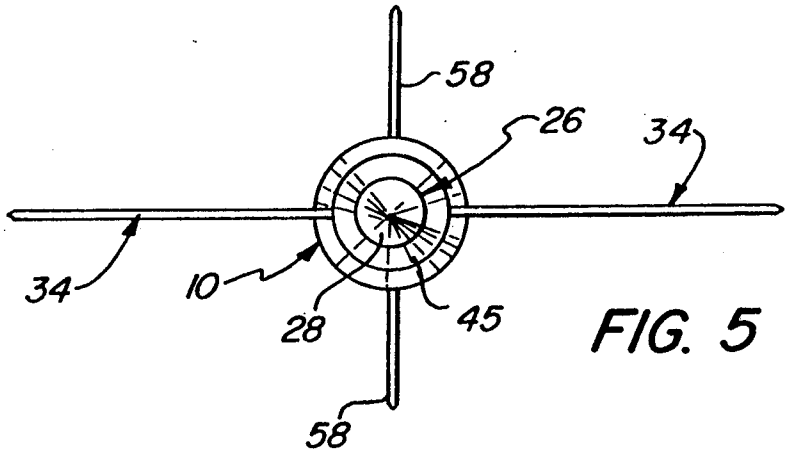
FIG. 5 is front view of the assembly in the condition depicted in FIG. 4.
Figure 4:
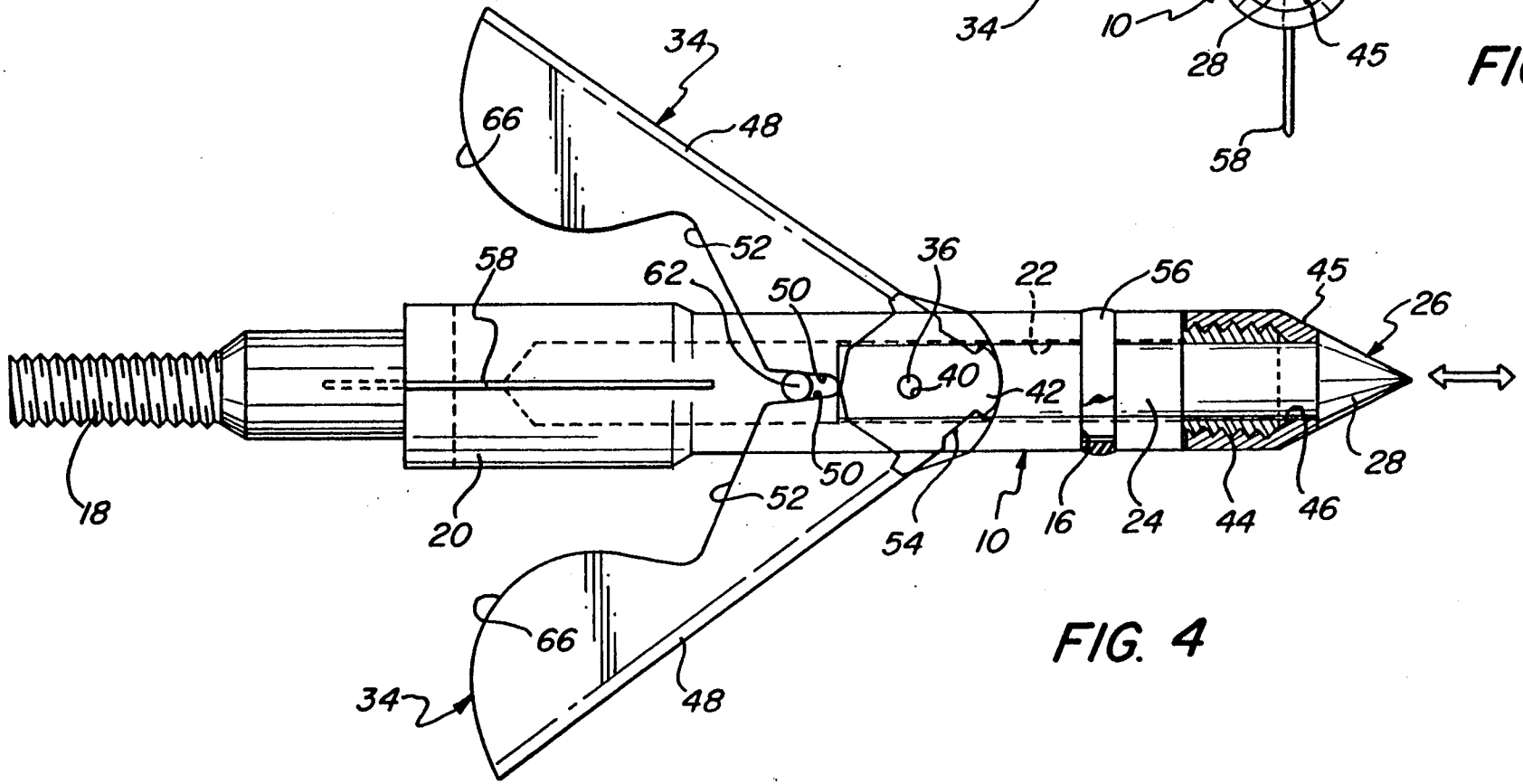
FIG. 4 is a plan view showing the movable blades of the broadhead constrained against further retraction from an extended, partially open position, with the actuating plunger fully depressed.

Operation of the broadhead can readily be appreciated by reference to the drawings, particularly FIGS. 1 and 4. As depicted in FIG. 1, the assembly is in its armed position, with the actuating plunger 26 extended forwardly from the body 10 and with the blades 34 closed and fully contained within the body. This of course avoids the presentation of discontinuities to the aerodynamic shape to the body, allowing the broadhead to follow a true trajectory toward the target with minimal deflection by wind and air currents.

Upon impact, the plunger 26 is depressed into the body 10, carrying with it of course the blades 34 pivotably mounted on the shaft 24. This in turn causes the positioning pin 62 to ride along at least a portion of the edge sections 52 on the blades 48 traveling thereby, camming or thrusting the blades outwardly due to the relationship of the sections 52 to the axis of pivoting; i.e., the edges angularly traverse the encompassed radii of the blade apertures 40. Inertia in the system causes the blades 34 to continue to move forwardly, normally bringing them to a position in which the sharpened edges 48 are aligned with one another and perpendicular to the longitudinal axis of the body, or are pitched even further therebeyond. Such a relationship is not shown in the drawings, but it will be appreciated that it results from the free pivoting action of the blades on the pin 36.

As the broadhead continues to penetrate the target, the blades are forced rearwardly and inwardly, until the edge sections 50 encounter the positioning pin 62, with which they register arcuately in the fully depressed position of the plunger 26. The pin 62 prevents further retraction of the blades into the body 10, thereby constraining them to an optimal orientation for further cutting and penetration; in the embodiment illustrated, the thus constrained, or locked, orientation of the blades is such that each of the cutting edges 48 forms an angle of about 36° with the axis of the broadhead body.

As mentioned previously, the locking edge section 50 of each blade extends substantially radially with respect to the aperture 40 thereof. It will be appreciated that such an orientation constrains the blades against further retraction by imparting no forward vector of force to the plunger 26. Indeed, the sections 50 urge movement of the plunger in neither direction, but they may of course be so oriented or configured as to impart a rearward vector if so desired, since movement of the plunger in that direction is prevented by abutment of the tip 28 upon the collar 44. It will also be appreciated that reference herein to a substantially radial relationship is intended to imply some offset of the sections 50, such as to accommodate the pin 62 within the recess that they form when the blades are in their locked positions.

The ability of the blades to swing freely facilitates withdrawal of the broadhead from the target, by effectively reducing its lateral expanse; the curvilinear edge sections 66 on the lobe-like blade portions also contribute to the same result. The assembly can readily be rearmed after removal, and that is achieved simply by pulling the actuating piston 26 forwardly from the body 10 while the blades 34 are pressed inwardly. This will permit the forward en portions 42 of the blades to be drawn through the plane of the O-ring 56, which will resiliently deform and thereafter contract to engage within the notches 54, thus holding the components in armed condition until discharged, as described; it will be noted that the edge section 68 of the blade, located forwardly adjacent the notch 54, is shaped to facilitate passage into the O-ring.

Thus, it can be seen that the present invention provides a movable-blade broadhead assembly of relatively uncomplicated design, which affords accurate arrow trajectories, is highly reliable in operation, and is highly effective for its intended purposes. The blades of the assembly are retracted during flight, and are released upon impact to pivot outwardly and forwardly, thereafter being constrained against full retraction at a desirable degree of extension. In addition to affording the foregoing features and advantages, the assembly of the invention is also of relatively facile and inexpensive manufacture.

Having thus described the invention, what is claimed is:

1. A broadhead assembly comprising:

an elongate body having forward and rearward ends and a longitudinal slot extending laterally therethrough, said body having means at said rearward end for attachment to an arrow shaft, and having means defining a passage extending on the longitudinal axis of said body between said forward end and said slot thereof;

an actuating plunger comprised of a shaft slidably mounted in said passage, and a tip disposed on the forward end of said plunger shaft outwardly of said passage, said plunger being movable between an armed, outward position with said shaft thereof extended from said body, and a discharged, inward position with said shaft depressed thereinto and said tip bearing upon said forward end of said body, said plunger shaft having blade-mounting means on a rearward end portion thereof;

a pair of substantially identical, substantially planar blades, each having a forward end portion with a pivot support element thereon, and opposing lateral edges extending generally rearwardly therefrom, one of said edges being sharpened and the other being formed with a positioning profile, said blades being seated in said body slot with said sharpened edges outwardly oriented and with said support elements thereon engaged with said mounting means on said plunger shaft for substantially free pivotable movement of said blades, in a substantially common plane, between closed position within said slot, in said armed position of said plunger, and open positions extended from said slot, in said discharged position of said plunger;

a positioning element extending transaxially in said body and traversing said slot at a location intermediate said ends of said body, said blades being disposed for engagement of said profile edges thereof upon said positioning element, each of said profile edges being comprised of a locking section, located proximate said pivot support element on said blade for registry with said positioning element in said discharged position of said plunger, and a thrust section extending rearwardly from said locking section, said thrust section being so disposed and configured as to cause said positioning element to effect extension of said blades, from said closed position, during inward movement of said plunger from said armed position to said discharged position thereof, and said locking section being so configured that inward, closing force applied to said blades in an open position thereof and transmitted through said locking sections produces no force vector tending to effect outward movement of said plunger, thereby serving to constrain said blades against full retraction to said closed position; and a pair of fixed blades mounted on said body adjacent said rearward end thereof, said fixed blades being disposed in mutual opposition and in a plane generally perpendicular to said common plane.

2. The assembly of claim 1 wherein said forward end portions of said blades have apertures formed therethrough to provide said support elements, wherein said rearward end portion of said plunger shaft is bifurcated and receives said forward end portions of said blades in overlapped relationship between the parts thereof, and wherein said blade mounting means includes a pin extending between said parts of said plunger shaft and through said blade apertures.

3. The assembly of claim 1 wherein said locking section of said blade profile edge is of substantially rectilinear configuration.

4. The assembly of claim 3 wherein said locking section extends substantially radially with respect to the axis of pivoting of said blade.

5. The assembly of claim 4 wherein said thrust section of said blade profile edge is also of substantially rectilinear configuration, and extends from said locking section toward said sharpened edge.

6. The assembly of claim 1 additionally including means for releasably engaging said blades in said closed position thereof.

7. The assembly of claim 6 wherein said means for engaging comprises an elastically deformable element surrounding said body at a location overlying said forward end portions of said blades in said closed position thereof, and structure on said blade forward end portions for engaging said deformable element, said engaging structure being so configured as to disengage from said deformable element under opening force applied to said blades.

8. A broadhead assembly comprising:

an elongate body having forward and rearward ends and a longitudinal slot extending laterally therethrough, said body having means at said rearward end for attachment to an arrow shaft, and having means defining a passage extending on the longitudinal axis of said body between said forward end and said slot thereof;

an actuating plunger comprised of a shaft slidably mounted in said passage, and a tip disposed on the forward end of said plunger shaft outwardly of said passage, said plunger being movable between an armed, outward position with said shaft thereof extended from said body, and a discharged, inward position with said shaft depressed thereinto and said tip bearing upon said forward end of said body, said plunger shaft having blade-mounting means on a rearward end portion thereof;

a pair of substantially identical blades, each having a forward end portion with a pivot support element thereon, and opposing lateral edges extending generally rearwardly therefrom, one of said edges being sharpened and the other being formed with a positioning profile, said blades being seated in said body slot with said sharpened edges outwardly oriented and with said support elements thereon engaged with said mounting means on said plunger shaft for substantially free pivotable movement of said blades between a closed position within said slot, in said armed position of said plunger, and open positions extended from said slot, in said discharged position of said plunger;

a positioning element extending transaxially in said body and traversing said slot at a location intermediate said ends of said body, said blades being disposed for engagement of said profile edges thereof upon said positioning element; and means for releasably engaging said blades in said closed position thereof, said means for engaging comprising an elastically deformable element surrounding said body at a location overlying said forward end portions of said blades in said closed position thereof, and structure on said blade forward end portions for engaging said deformable element, said engaging structure being so configured as to disengage from said deformable element under opening force applied to said blades; each of said profile edges being comprised of a locking section, located proximate said pivot support element on said blade for registry with said positioning element in said discharged position of said plunger, and a thrust section extending rearwardly from said locking section, said thrust section being so disposed and configured as to cause said positioning element to effect extension of said blades, from said closed position, during inward movement of said plunger from said armed position to said discharged position thereof, and said locking section being so configured that inward, closing force applied to said blades in an open position thereof and transmitted through said locking sections produces n force vector tending to effect outward movement of said plunger, thereby serving to constrain said blades against full retraction to said closed position.

9. The assembly of claim 8 wherein said forward end portions of said blades have apertures formed therethrough to provide said support elements, wherein said rearward end portion of said plunger shaft is bifurcated and receives said forward end portions of said blades in overlapped relationship between the parts thereof, and wherein said blade mounting means includes a pin extending between said parts of said plunger shaft and through said blade apertures.

10. The assembly of claim 8 wherein said locking section of said blade profile edge is of substantially rectilinear configuration, and extends substantially radially with respect to the axis of pivoting of said blades.

11. The assembly of claim 8 wherein said body is of generally cylindrical form, wherein said slot extends diametrically therethrough, and wherein said blades are entirely contained within said body in said closed position thereof.

12. The assembly of claim 8 wherein said positioning element is a pin affixed in said body.

13. The assembly of claim 8 wherein said sharpened edge of said blade, and said locking and thrust sections of said profile edge thereof, are all of substantially rectilinear configuration, and wherein said locking section and said thrust section, respectively, diverge rearwardly from and converge rearwardly toward said sharpened edge.

14. The assembly of claim 8, wherein said blades are substantially planar and are disposed to move in substantially a common plane.

15. The assembly of claim 14 additionally including a pair of fixed blades mounted on said body adjacent said rearward end thereof, said fixed blades being disposed in mutual opposition and in a plane generally perpendicular to said common plane.

* * * * *